US005117611A

United States Patent [19]

Heck et al.

[11] Patent Number: 5,117,611

[45] Date of Patent: Jun. 2, 1992

[54] METHOD AND APPARATUS FOR PACKING LAYERS OF ARTICLES

[75] Inventors: Richard D. Heck, Riverside; Don Dossey, Montclair; Alfredo Acevedo, Yucaipa, all of Calif.

[73] Assignee: Sunkist Growers, Inc., Sherman Oaks, Calif.

[21] Appl. No.: 475,934

[22] Filed: Feb. 6, 1990 (Under 37 CFR 1.47)

[51] Int. Cl.[5] ..... B65B 39/12; B65B 39/02; B65B 35/38

[52] U.S. Cl. ..... 53/475; 53/247; 53/258; 53/262

[58] Field of Search ..... 53/247, 255, 258, 261, 53/262, 543, 505, 506, 448, 475

[56] References Cited

U.S. PATENT DOCUMENTS

| | | | |
|---|---|---|---|
| 2,031,005 | 2/1936 | Renfroe | 53/262 |
| 2,656,081 | 10/1953 | Davis | 53/247 |
| 2,753,673 | 7/1956 | Olive | 53/247 |
| 3,001,350 | 9/1961 | Heblij | 53/261 X |
| 3,031,820 | 5/1962 | Schulze et al. | 53/247 |
| 3,069,823 | 12/1962 | Schmid | 53/543 X |
| 3,142,141 | 7/1964 | Walter | 53/262 X |
| 3,453,802 | 7/1969 | Riddington | 53/255 X |
| 3,553,932 | 1/1971 | Rowekamp | 53/247 X |
| 3,634,996 | 1/1972 | Reichert et al. | 53/543 X |
| 3,673,756 | 7/1972 | Prete et al. | 53/247 X |
| 3,942,303 | 3/1976 | Kristiansen | 53/247 X |
| 4,055,943 | 11/1977 | Reichert | 53/247 |
| 4,300,330 | 11/1981 | Hartness | 53/247 X |
| 4,386,491 | 6/1983 | Cramer et al. | 53/261 X |
| 4,457,121 | 7/1984 | Johnson et al. | 53/247 X |

*Primary Examiner*—Horace M. Culver

*Attorney, Agent, or Firm*—Stephen J. Koundakjian; Paul Del Giudice

[57] ABSTRACT

An apparatus for packing closely-arranged articles into a receptacle includes a rigid funnel having inwardly sloping walls and a downwardly projecting flexible skirt means attached to the funnel. The flexible skirt comprises a plurality of flexible planar segments that project downwardly into the receptacle. The funnel and skirt are lowered into an empty receptacle, the articles are packed, and the funnel and skirt are lifted out. The skirt means avoids contact between the articles and the walls of the receptacle as the receptacle is being packed, thereby decreasing the potential for damage to the articles. The apparatus includes a switch that stops the downward movement of the funnel and skirt when the bottom edge of the skirt is adjacent the bottom of the receptacle.

18 Claims, 2 Drawing Sheets

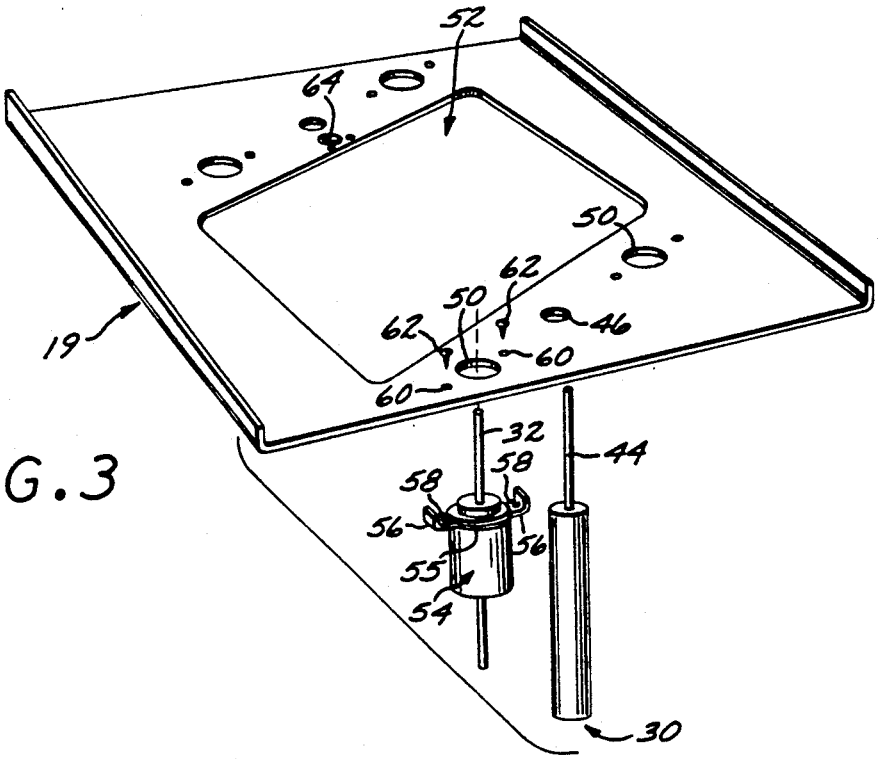
FIG. 3
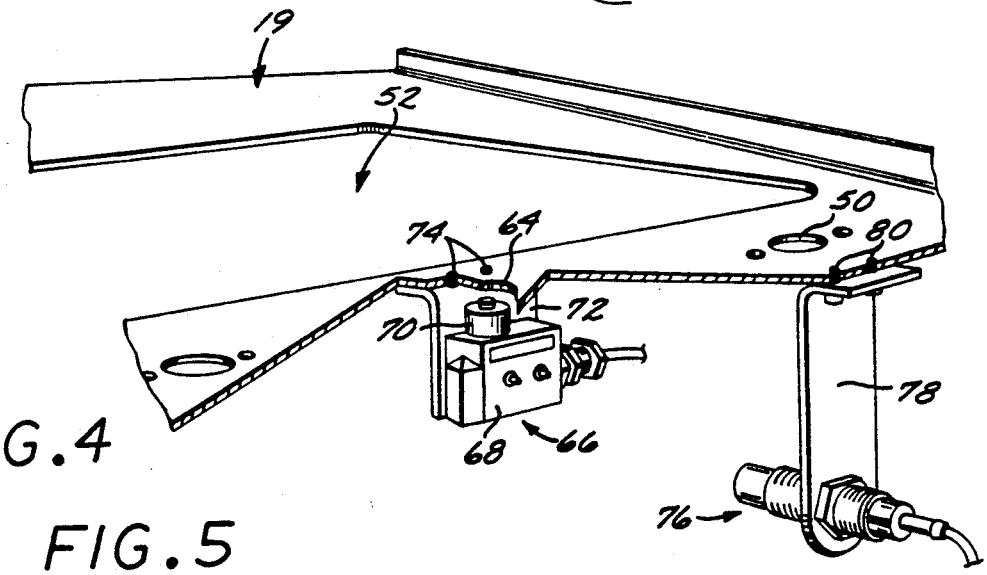
FIG. 4
FIG. 5
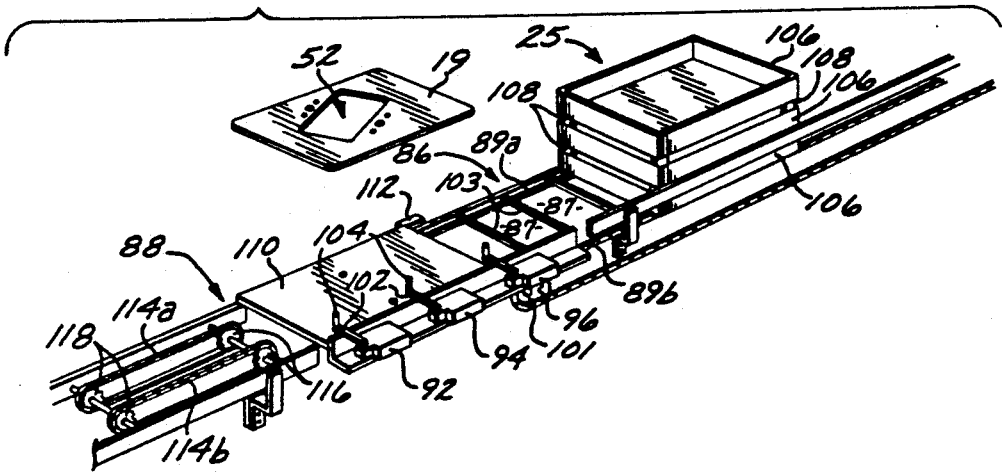

METHOD AND APPARATUS FOR PACKING LAYERS OF ARTICLES

BACKGROUND OF THE INVENTION

1. Field of the Invention

This invention relates generally to packaging articles by depositing them in a receptacle and, more particularly, to automatically packing a succession of layers of articles upon another in an open receptacle.

2. Description of the Related Art

Fruit and vegetables are typically packed in receptacles such as cartons or crates, to be transported to distribution warehouses, grocers, and consumers. In the case of spherical fruit, such as oranges, the packing typically is accomplished by arranging the fruit on two feed chutes that feed the fruit to positions at the end of each chute in rows so as to form arrays of closely-arranged fruit. A carton or other receptacle is positioned between the two chutes, and successive alternate fruit arrays are lifted from each feed chute by an associated lifting head and are placed into the box. Fruit arrays are lifted and placed in the carton until it is filled, at which point the carton is taken away and a new carton is placed into position. A lifting apparatus of this general type is described, for example, in U.S. Pat. No. 3,453,802.

Movable guide panels have been used to center each rectangular carton being filled with fruit and to guide the fruit arrays past the carton's top edge. The guide panels generally comprise short, curved ramps that are moved downwardly over the top edge of the carton before the lifting heads insert the fruit. The guide panels apply equal forces to opposite walls of the carton and thereby center it. The guide panels also reduce the amount of friction experienced by the fruit while being placed in the box, reducing damage to the fruit. After the box is filled, the guide panels are retracted and the carton is moved away. A packing apparatus using such guide panels, for example, is discussed in U.S. Pat. No. 4,386,491.

Although the aforementioned guide panels improve the operation of such a packing apparatus, there may be slight variations in the dimensions and construction of the receptacles that result in non-centering of receptacles and make the guide panels less than optimal. Also, although the guide panels help to properly position the fruit arrays within the receptacle, it is possible for the fruit to come into contact with the sides of the receptacle after the fruit has descended below the level of the guide panels. This contact can damage the fruit and can lead to spoilage. Variations in dimensions and damage from contact are more likely where the receptacles take the form of wooden crates.

Thus, there is a need for a fruit-packing apparatus that centers a receptacle in position for a lifting head and that protects the fruit from contact with the interior walls of the receptacle. There is also a need for such an apparatus that can accommodate receptacles of different sizes and construction. The present invention meets that need.

SUMMARY OF THE INVENTION

In accordance with the present invention, an apparatus is provided for packing successive layers of articles carried by a lifting head into a receptacle, the apparatus centering the receptacle beneath the lifting head, protecting the articles from contact with the inside walls of the receptacle, and accommodating receptacles that have differing dimensions and are constructed of various materials.

A packing apparatus in accordance with the present invention includes a rigid funnel having attached to it a downwardly-projecting, flexible skirt means of gradually decreasing cross-section, the funnel and skirt being moved downwardly toward an empty receptacle until the skirt is substantially completely within the receptacle and its lower edge is adjacent to the bottom of the receptacle. The skirt means is preferably constructed from a flexible, low-friction material having a smooth surface. The downwardly projecting skirt means performs a centering and protecting function as it is lowered into the receptacle. That is, if the receptacle is not properly centered, the skirt will push against the inner walls of the receptacle to move it laterally into a centered position as the skirt is lowered. The groups of articles that are lowered into the receptacle are protected from contact with the inside walls of the receptacle by the funnel and skirt means, or tucker assembly, and therefore the articles will avoid becoming damaged or scuffed as they are packed.

In more detailed features of the present invention, the funnel of the tucker assembly comprises four curved, downwardly sloping walls having a top edge larger across than the top of the receptacle, and a lower edge slightly smaller across than the receptacle, while the flexible skirt means comprises a plurality of planar skirt segments constructed from a low-friction material such as polyethylene, each skirt segment being attached to one of the downwardly sloping walls of the funnel. The skirt segments project somewhat inwardly toward each other because they are attached to the inwardly sloping walls of the funnel. When a lifting head holding articles is lowered into the receptacle, the skirt panels can flex outwardly toward the walls of the receptacle, allowing the articles to move past without damage. An apparatus in accordance with the present invention also includes a switch that is activated when the tucker assembly is lowered, the switch being tripped when the bottom edge of the skirt is positioned near the bottom of the receptacle. The switch may be activated by a spring-biased rod connected to the tucker assembly.

A packing apparatus in accordance with the present invention includes a plurality of sensors for indicating when an empty receptacle is properly positioned for loading. Small variations in the receptacle dimensions are accommodated by the centering action of the tucker assembly, but large variations trigger the sensors and cause the apparatus to stop its packing operation, whereupon a human operator can intervene. The packing apparatus also includes a lifting platform to raise the receptacle toward the lifting heads, thereby accommodating receptacles of various standardized heights.

Other features and advantages of the present invention should become apparent from the following description of the preferred embodiment, which illustrates, by way of example, the principles of the invention.

BRIEF DESCRIPTION OF THE DRAWINGS

FIG. 3 is a perspective view of a support plate included in the apparatus of FIG. 1.

FIG. 4 is a detailed perspective view of the support plate of FIG. 3, showing sensors used to determine a proper positioning of the funnel and attached skirt relative to the crate being packed.

FIG. 5 is a perspective view of a portion of the packing apparatus of FIG. 1 that delivers a succession of wooden crates for packing.

DESCRIPTION OF THE PREFERRED EMBODIMENT

The following description of the present invention is not to be taken in a limiting sense, but is made merely for the purpose of illustrating the general principles of the invention. The scope of the invention is best defined by the appended claims. The following description is of the best presently contemplated mode of carrying out the present invention.

Figure 1:
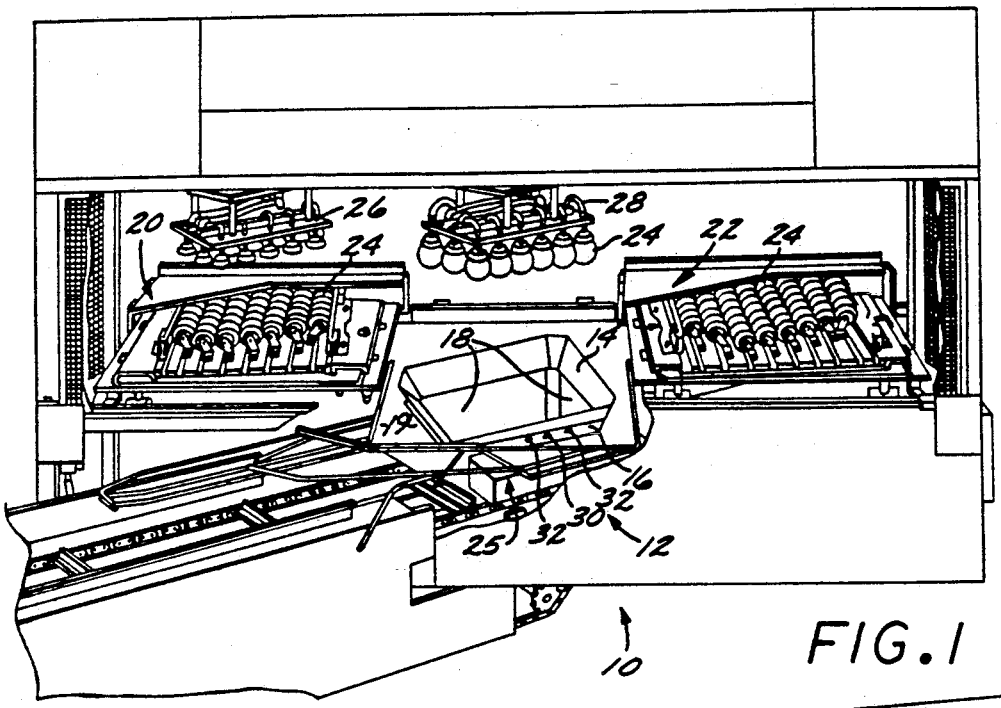
FIG. 1 is a perspective view of a packing apparatus in accordance with the present invention, for packing a number of successive layers of generally spherical fruit in a wooden crate.

A perspective view of a packing apparatus 10 in accordance with the present invention is illustrated in FIG. 1. The packing apparatus includes a rigid funnel 14 with sloping side walls having a supporting frame 16 encircling the outside of the funnel and a flexible skirt 18 attached to the outside of the funnel. The funnel, frame, and skirt comprise a tucker assembly 12. The packing apparatus includes a left supply station 20 and a right supply station 22 for lifting articles and placing them in a receptacle. In the illustrated embodiment, the articles comprise spherical fruit 24, such as oranges, to be packed into an open top receptacle 25 having a bottom wall and upright side walls.

The packing apparatus 10 includes a left pickup head 26 and a right pickup head 28. The supply stations 20, 22 deliver fruit 24 to the pickup heads that lift the fruit and deposit them into the receptacle 25. Typical vacuum-operated pickup heads are described, for example, in U.S. Pat. No. 3,453,802. The tucker assembly 12 of the present invention is lowered into the empty receptacle and pushes against its inside walls if it is slightly off center. Thus, the tucker assembly performs a centering function for empty receptacles. The tucker assembly is lowered until its skirt is substantially adjacent the bottom of the receptacle. The fruit is then packed by the pickup heads descending into the receptacle, shielded by the funnel 14 and skirt 18, and depositing their load of fruit. The fruit presses the skirt against the walls of the receptacle, preventing the skirt from working loose. Thus, the tucker assembly performs a protecting function to prevent contact between the fruit and the receptacle walls.

The two pickup heads 26, 28 project downwardly from a carriage structure not illustrated in FIG. 1. The left pickup head 26 lifts fruit that has been closely arranged in a nested configuration from the left supply station 20, while the right pickup head 28 lifts fruit from the right supply station 22. The left and right pickup heads are operatively connected such that the pickup heads alternate between being positioned above their respective supply stations and above the tucker assembly 12. That is, when the left pickup head is positioned over the left supply station, the right pickup head is positioned over the tucker assembly, and when the right pickup head is positioned over the right supply station, the left pickup head is positioned over the tucker assembly. When one of the pickup heads is positioned over the tucker assembly, that head descends to deposit a layer of fruit 24 in the receptacle 25. The illustrated packing apparatus 10 operates under the control of a computer (not illustrated) that is programmed with the number of layers necessary to fill the receptacle. Those skilled in the art will recognize that computer control of the packing apparatus is not necessary. Alternative control schemes will occur to those skilled in the art and need not be described here.

After the last layer of fruit is deposited in the receptacle, the lifting head remains in its downward position and the tucker assembly 12 is lifted upward. Although the fruit presses the skirt against the walls of the receptacle, the lifting head serves to hold the fruit in place as the tucker assembly overcomes the frictional force between the skirt and the fruit. This ensures that none of the fruit are lifted out of the receptacle by the upwardly moving skirt. The skirt is constructed from a low-friction material for easier removal of the tucker assembly. After the skirt clears the receptacle, the lifting head is raised, the full receptacle is taken away on a conveyor 29, and the packing cycle is repeated.

Figure 2:
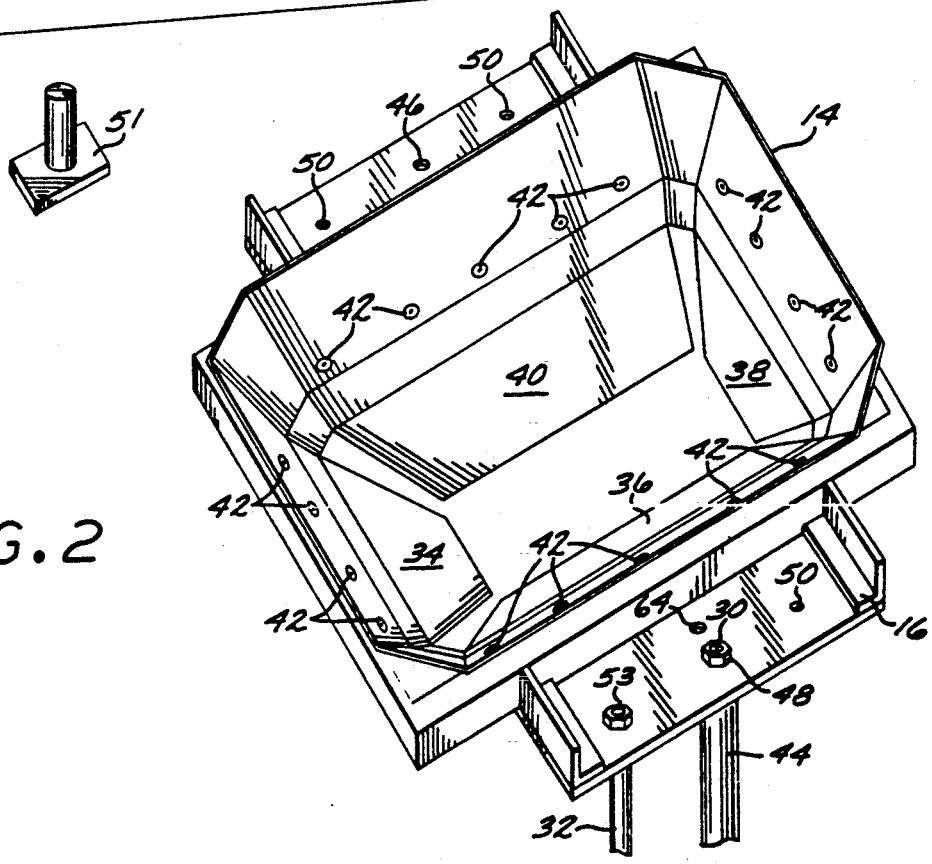
FIG. 2 is a perspective view of a preferred embodiment of the funnel and attached skirt of the apparatus of FIG. 1.

The funnel 14, shown most clearly in FIG. 2, has four generally curved side walls wherein the top edge of the funnel has a cross-sectional area greater than that of the receptacle, while the bottom edge of the funnel has a cross-sectional area less than that of the receptacle. The side walls make an angle of approximately 10° to 15° with the vertical. In the preferred embodiment, the funnel is constructed of aluminum, but other lightweight, rigid materials may be used. The frame 16 is attached to the funnel by welding. The flexible skirt 18 comprises a plurality of planar, low-friction sheets 34, 36, 38, and 40. The flexible planar sheets are preferably attached to the outside surface of the funnel by a plurality of screws 42 passing through the funnel, below the point of attachment of the frame to the funnel. The planar sheets are constructed of a flexible, low friction material, such as polyethylene. The planar sheets protect the fruit 24 from contact with the sides of the receptacle 25 and thereby prevent damage during packing. For example, receptacles constructed of wooden slats may have sharp splinters projecting toward the fruit that could otherwise puncture and damage the fruit as it is lowered into the receptacle. The tucker assembly prevents this from happening.

The tucker assembly is raised and lowered by a pair of drive cylinders 30 attached to the frame 16. Each drive cylinder includes a drive rod 44 that reciprocates upwardly and downwardly from a piston (not illustrated). The free end of each drive rod extends through a drive cylinder hole 46 in the frame 16 and is securely attached to the frame by a drive rod nut 48. A pair of guide rods 32 are also attached to the frame, and flank each drive cylinder. Each drive cylinder hole 46 in the frame is flanked by a pair of guide rod holes 50 for the guide rods. The end of each guide rod is securely attached to the frame by a guide rod nut 53 at the guide rod holes. When the drive rods 44 are extended upwardly, the frame is lifted upwardly and is guided in its movement by the guide rods 32.

The preferred embodiment of the packing apparatus includes a fixed support plate 19, as shown in FIG. 3. The support plate includes a central opening 52 through which the skirt and the lifting heads 26, 28 pass. As noted, the support plate also includes a pair of drive cylinder holes 46, through which the drive cylinder rods 44 pass, and two pairs of guide rod holes 50, through which the guide rods 32 pass. The guide rods are supported in position by a bushing housing 54 attached to the underside of the plate, and through which each guide rod passes. Each housing is provided with a circumferential groove 55 into which one end of paired angled tabs 56 are inserted, each tab having a threaded hole 58. Each guide rod hole 50 in the plate is provided with two flanking bushing tab holes 60. When the bushing housing is placed in its proper position adjacent the underside of the support plate 19, and the tabs are properly located with one end in the groove 55 and the other end abutting the underside of the support plate, the holes 58 of the angled tabs align with the bushing tab holes 60 of the support plate 19. An attaching means such as a threaded screw 62 is used to firmly attach the tabs to the plate, holding the bushing housing in place. The support plate also includes a limit switch access hole 64. The access hole is provided in conjunction with a limit switch 66 for indicating the downward motion of the tucker assembly 12, as described more fully below.

The support plate 19 is shown in FIG. 4 from the opposite end from that illustrated in FIG. 3 in a cutaway view. The downward motion of the tucker assembly 12 is limited by the extent of travel of the drive cylinders 30. When the drive cylinders reach the end of their travel, a spring-biased rod 51 makes contact with the limit switch 66, generating a signal. The rod is allowed approximately one-half inch of travel by a coil spring (not illustrated). The limit switch is positioned beneath the plate 19 and includes a body 68 and a switch button 70 centered below the access hole 64. The body of the switch is attached to a mounting bracket 72, which is attached to the underside of the support plate by two attachment screws 74.

As the tucker assembly 12 is lowered and reaches the end of its range of downward travel, the skirt's bottom edge 33 nears the bottom of the receptacle 25, and the bottom of the spring-biased rod 51 passes through the limit switch access hole 64 and nears the limit switch 66. The skirt is selected to project from the funnel such that when the bottom edge of the skirt is approximately one inch from the bottom of the receptacle, the bottom of the spring-biased rod makes contact with the limit switch. The spring cushions the rod and prevents it from rigidly hitting the switch and cracking it, especially when the packing apparatus is being set up and the operating limits and dimensions of travel are not firmly established. The spring, however, is sufficiently stiff for the rod to depress the limit switch and signal the controlling computer that the tucker has reached the limit of its travel, and therefore loading of the receptacle may begin.

A proximity sensor 76 is positioned below the plate 19, as shown in FIG. 4. The proximity sensor is a magnetic-type sensor that detects the presence of a ferrous material, and is located near one of the guide rods 32, in alignment with the rod's vertical path of travel, but spaced outwardly therefrom. Therefore, at least the guide rod associated with the sensor is constructed from a ferrous material. The sensor is supported from the bottom of the plate 19 by a mounting bracket 78, which is attached to the plate by two attachment screws 80 spaced apart from the associated guide rod hole 50.

The proximity sensor 76 detects the absence of the guide rod 32, indicating that the tucker assembly 12 has been raised and that a full receptacle can be taken away and an empty receptacle brought in its place. More precisely, when the tucker assembly is raised after the last array of articles has been placed in a receptacle, the guide rods will be at their highest point of travel. Due to the placement of the proximity sensor, the bottom end of the guide rod associated with the sensor will be clear of the proximity sensor 76. This condition is detected by the sensor and is used by the controlling computer to initiate movement of a receptacle on a conveyor 84.

The delivery of a receptacle 25 to the packing apparatus 10 is shown in FIG. 5. Only those elements necessary for an understanding of the operations discussed below are illustrated in FIG. 5, the non-essential elements being eliminated from the drawing for clarity. The support plate 19 is shown relative to an approaching empty receptacle 25 that is to be filled with fruit. The receptacle is transported along the conveyor 84 to a position beneath the support plate. The conveyor includes an approach segment 86 that carries empty receptacles into position, and a departure segment 88 that carries full receptacles away.

A plurality of receptacle sensors 90 perform the function of verifying that an empty receptacle 25 is in its proper position beneath the support plate 19 and lifting heads 26, 28. The illustrated sensors comprise three swing-arm sensors 92, 94, and 96 located along the conveyor 84 in series. Each sensor includes a housing 98, a vertically projecting rod 100, a swing arm 102, and a vertical bar 104 attached to the end of the arm. The vertical rod pivots about its longitudinal axis, thereby moving the bar in an arc. The vertical rod 100 is biased to swing the bar toward a receptacle on the conveyor. A sensor is tripped, or placed in an active state, when the swing arm 102 and bar 104 are pushed away from the conveyor by an approaching receptacle. The sensors are located such that only the middle sensor 94 is tripped when a receptacle is properly positioned beneath the support plate central opening 52. That is, a receptacle that is properly aligned under the lifting heads will trip only the middle sensor. If either one of the remaining sensors 92 or 96 is also tripped, it indicates that the receptacle is not properly positioned. In the preferred embodiment, the computer allows a predetermined time for the tucker assembly to be lowered, filled, moved away, and a new receptacle properly positioned in its place. This time is approximately 2 seconds. Once this time is exceeded and the sensors 90 have not indicated proper positioning of an empty receptacle, power to the apparatus is turned off, in which case the apparatus is stopped and a human operator must intervene. This also indicates that the apparatus requires adjustment.

The sensors illustrated in FIG. 5 are especially suited for receptacles comprising crates constructed from slats. Such receptacles typically include longitudinally extending slats 106 that are spaced apart, thereby creating longitudinally extending empty spaces 108 between the slats. The vertically extending rod 104 is selected to be long enough so as to make contact with more than one of the slats and to bridge the empty spaces. In this way, the arm 102 cannot move into an empty space 108 between two slats 106. If the sensors 90 did not include the vertically extending rod 104 and slatted receptacles were used, the arm 102 could be at a height that would allow the arm to swing into an empty space between slats, thereby incorrectly indicating the absence of a receptacle.

The approach segment 86 of the conveyor delivers empty receptacles 25 for packing and, once filled, moves the receptacles onto the departure segment 88 of the conveyor 84. A lifting platform 110 is located between the end of the approach segment and the beginning of the departure segment. When an empty receptacle is properly positioned and has come to a stop on the lifting platform, the platform can be raised, lifting the receptacle and moving it upward toward the central opening 52. In the preferred embodiment, approximately 3 to 6 inches of vertical lift can be accommodated. This lifting helps the packing apparatus to accommodate receptacles that have slightly different depths. In particular, the vertical travel of the platform can be selected such that industry standard half-size boxes can be used. When full-size boxes are to be packed, generally no lift is required. When half-size boxes are used, full lift will typically be necessary for proper positioning.

In the preferred embodiment illustrated, the approach segment 86 comprises a slider bed 87 and two parallel linked chains 89*a*, 89*b* rotating about paired sprockets 101 and straddling the slider bed. The sprockets define the end of the approach segment and are located adjacent the upstream end of the lifting platform. A plurality of angled bars 103 extend transversely from one chain to the other at intervals at least equal to the length of the receptacles and at a height of approximately three inches above the slider bed. The top surface of the slider bed supports the receptacles as they move down the approach segment. The angled bars include a vertical segment that extends upwardly, and serve to engage the empty receptacles and space them along the approach segment while the receptacles themselves slide along the top surface of the slider bed. As a line of empty receptacles is moved along toward the lifting platform, the approach segment 86 is made to stop as the first empty receptacle is pushed onto the platform by the following receptacle, just before one of the angled bars 103 pushing a receptacle reaches the platform 110. The platform can then be raised and lowered as described above, with the receptacle being filled.

Movement of the approach segment is indicated by a switch 112 located just upstream of the platform that is triggered by a passing angled bar 103, generating a signal that is provided to the controlling computer. This informs the computer that a receptacle is in position for filling. When a filled receptacle is ready to be moved off of the platform, the linked chains of the approach segment are moved and the angled bars once again push on empty receptacles, pushing the filled receptacle off the platform and onto the departure segment, and pushing a new empty receptacle onto the platform. When the filled receptacle is pushed off the platform, it is pushed onto the moving departure segment 88 and is carried away from the platform. The departure segment comprises two parallel linked chains 114*a*, 114*b* rotating about paired sprockets 116 and 118. The chains are approximately 6 to 8 inches apart and support the filled receptacles The present invention has been described above in terms of a presently preferred embodiment so that an understanding of the present invention may be conveyed. There are, however, many configurations for packing devices not specifically described herein, but with which the present invention is applicable. The present invention should therefore not be seen as limited to the particular embodiment described herein, but rather, it should be understood that the present invention has wide applicability with respect to packing devices. Such other configurations may be achieved by those skilled in the art in view of the descriptions herein.

We claim:

1. An apparatus for packing closely-arranged articles into an open receptacle of substantially predetermined depth for use with a lifting means for lifting the articles from a first location and transporting them into the receptacle, the apparatus comprising:

a receptacle support on which the receptacle can be located;

a rigid funnel movably suspended above the receptacle support;

skirt means attached to the rigid funnel and projecting downwardly therefrom;

drive means for moving the funnel and skirt means downwardly toward the receptacle support until the skirt means is substantially within the receptacle and the lower edge of the skirt means is substantially adjacent the bottom of the receptacle; and a stationary support plate having an opening through which the lifting means passes when transporting the articles and through which substantially all of the skirt means passes when being moved downwardly toward the receptacle.

2. An apparatus as recited in claim 1, wherein the rigid funnel is constructed from aluminum.

3. An apparatus as recited in claim 1, wherein the skirt means comprises a plurality of flexible planar segments.

4. An apparatus as recited in claim 1, wherein the rigid funnel comprises a rectangular frame having curved, inwardly-sloping walls.

5. An apparatus as recited in claim 4, wherein the skirt means comprises a plurality of planar segments, and each segment is attached to one of the inwardly sloping walls of the funnel.

6. An apparatus as recited in claim 1, wherein the skirt means is constructed of a low friction flexible material.

7. An apparatus as recited in claim 6, wherein the skirt means is constructed of polyethylene.

8. An apparatus as recited in claim 6, wherein the funnel comprises a frame having curved side walls to which the skirt means is attached.

9. An apparatus as recited in claim 1, wherein the tucker means includes limit means for stopping the downward movement of the funnel and skirt means.

10. An apparatus as recited in claim 9, wherein the limit means comprises a switch activated by the lowering of the tucker means.

11. An apparatus as recited in claim 1, wherein the funnel comprises a generally rectangular frame having downwardly and inwardly sloping walls, and the skirt means comprises a plurality of flat flexible panels, each panel being attached along one edge to a separate one of the sloping walls.

12. An apparatus as recited in claim 11, further including a switch attached to the support plate that is depressed when the funnel and skirt means are moved downwardly, thereby limiting the downward travel of the funnel and skirt means.

13. An apparatus as recited in claim 12, further including a spring-loaded rod attached to the frame and adapted to depress the switch.

14. An apparatus for packing a succession of layers of fruit into a box of predetermined depth for use with a lifting head that transports each successive layer of fruit into the box, the apparatus comprising:

box support means for locating the box at a loading location;

a funnel comprising a frame having flat, downwardly sloping walls;

skirt means comprising a plurality of flexible panels attached to the funnel;

drive means for moving the funnel downwardly toward the box support means;

a proximity switch for indicating the downward travel of the funnel and skirt means when the skirt means has been moved by the drive means and has reached a predetermined location near the bottom of the box;

a stationary plate having an access opening through which the lifting head passes when transporting the fruit and through which substantially all of the skirt means passes when being moved downwardly toward the box; and a spring-biased rod attached to the frame and adapted to depress the proximity switch when the skirt means and frame are lowered.

15. An apparatus as recited in claim 14, further including receptacle positioning means for positioning an empty receptacle in a position substantially centered about the access opening.

16. An apparatus as recited in claim 15, wherein the receptacle positioning means includes a series of swing-arm switches that detect the presence of an adjacent receptacle.

17. An apparatus as recited in claim 14 further including a lifting platform that lifts a receptacle upward toward the lifting head.

18. A method for packing a plurality of articles into a receptacle in successive layers of arrays, wherein the receptacle includes a bottom wall and upright walls and is placed on a receptacle support, the method comprising the steps of:

lowering a frame and skirt combination downwardly toward the receptacle support, the combination having a frame with rigid downwardly projecting and inwardly sloping walls and a flexible skirt attached to the frame walls, wherein the step of lowering is terminated when the lower edge of the skirt is substantially adjacent the bottom wall of the receptacle placed on the receptacle support;

lowering successive arrays of the articles into the placed receptacle, past the frame and skirt combination, such that the articles are substantially adjacent and above the highest level or articles already in the receptacle, until the receptacle is substantially full, wherein the skirt keeps the articles separated from the upright walls of the receptacle; and raising the frame and skirt combination until the lower edge of the skirt is substantially above the top of the placed receptacle.

* * * * *